US006667579B2

(12) United States Patent
Kanazawa et al.

(10) Patent No.: US 6,667,579 B2
(45) Date of Patent: Dec. 23, 2003

(54) PLASMA DISPLAY PANEL AND METHOD OF DRIVING THE SAME

(75) Inventors: Yoshikazu Kanazawa, Kawasaki (JP); Noriaki Setoguchi, Higashimorokata (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 56 days.

(21) Appl. No.: 09/942,732

(22) Filed: Aug. 31, 2001

(65) Prior Publication Data

US 2002/0053882 A1 May 9, 2002

(30) Foreign Application Priority Data

Nov. 7, 2000 (JP) ..... 2000-339502

(51) Int. Cl.[7] ..... G09G 3/10

(52) U.S. Cl. ..... 315/169.3; 315/169.4; 345/60

(58) Field of Search ..... 315/169.1, 169.3, 315/169.4; 345/60, 62, 66, 67, 68, 76, 77, 87; 313/585, 485

(56) References Cited

U.S. PATENT DOCUMENTS

| | | | | |
|---|---|---|---|---|
| 5,877,734 A | * | 3/1999 | Amemiya | 345/60 |
| 6,181,305 B1 | * | 1/2001 | Nguyen et al. | 345/60 |
| 6,483,251 B2 | * | 11/2002 | Setoguchi et al. | 315/169.3 |
| 6,492,776 B2 | * | 12/2002 | Rutherford | 315/169.3 |

FOREIGN PATENT DOCUMENTS

| | | |
|---|---|---|
| EP | 0 762 373 A3 | 3/1997 |
| EP | 0 762 373 A2 | 3/1997 |
| EP | 0 965 975 A1 | 12/1999 |

* cited by examiner

*Primary Examiner*—Don Wong
*Assistant Examiner*—Jimmy T. Vu
(74) *Attorney, Agent, or Firm*—Staas & Halsey LLP

(57) ABSTRACT

In a plasma display panel with stable performance and high contrast, even when a voltage that changes gradually as time goes by is applied between the first and the second electrodes so that a discharge is caused to occur only in a cell that was lit in the preceding subfield, the neighboring cell write, in which the wall charges that remain on one side of the different display lines contiguous to the cell that was lit in the preceding cell are eliminated, is provided before or after the write period.

29 Claims, 18 Drawing Sheets

PLASMA DISPLAY PANEL AND METHOD OF DRIVING THE SAME

BACKGROUND OF THE INVENTION

The present invention relates to a plasma display panel and a method of driving same. More particularly, the present invention relates to a technology to improve the display contrast while maintaining the performance stability in a plasma display panel of ALIS (Alternate Lighting of Surfaces) method in which every space between adjacent sustain electrodes is used as a display line.

A plasma display panel is a device in which a space of about 100 micron width between two glass substrates on which electrodes are formed is filled with mixed gases, consisting of gases such as Ne and Xe, for discharge, a voltage greater than the discharge start voltage is applied to cause a discharge to occur, and fluorescent materials formed on the substrates are activated, to emit light, by the ultraviolet rays generated by the discharge.

FIG. 1 is a diagram that shows the structure of a display apparatus employing a plasma display panel. In a display panel 10, first electrodes 1 and second electrodes 2 arranged in parallel are formed, and third electrodes 3 are formed so as to be perpendicular to them. The first and the second electrodes are used mainly to perform a sustain discharge for display light emission, and the first electrodes are referred to as X electrodes, and similarly the second electrodes, as Y electrodes, here. A sustain discharge is performed by applying a voltage pulse repeatedly between the X electrode and the Y electrode. Moreover, some electrodes serve as a scanning electrode when display data is written. (In this example, the Y electrode is the scanning electrode.) On the other hand, the third electrode is used to select a display cell that is made to emit light in each display line, and a voltage is applied to perform a write discharge to select a cell to be made to discharge between the first or the second electrode and the third electrode. The third electrode is referred to as an address electrode here. These electrodes are connected to drive circuits to generate a voltage pulse to meet each purpose. As shown schematically, the X electrodes are connected to an X electrode drive circuit 12 and common drive signals are applied to the X electrodes. The X electrode drive circuit 12 has an X sustain pulse circuit 13 and an X reset voltage generate circuit 14. The Y electrodes are connected to a Y electrode drive circuit 15. The Y electrode drive circuit 15 has a scanning driver 16, a Y sustain pulse circuit 17, and a Y reset/address voltage generate circuit 18. The address electrodes are connected to an address driver 11. Because a display apparatus employing the plasma display panel is described in detail in EP 0 762 373 A2, and so on, which will be described later, no description is provided here.

FIG. 2 is a diagram to describe in detail the display panel part of the apparatus shown in FIG. 1. The plural X electrodes 1 and the plural Y electrodes 2 are arranged in parallel. Display lines L1 through L4 are shown here. In addition, partitioning walls 5 are formed to separate the address electrodes 3 and the display cells. Therefore, each display cell is separated by the partitioning wall 5 in the direction that the X electrodes and the Y electrodes extend.

FIG. 3 is a diagram that shows the structure of a frame to illustrate the drive sequence of the apparatus shown in FIG. 1. Because the discharge of a plasma display panel has only two values, that is, ON or OFF, the degree of brightness, that is, the gradation scale is represented by number of light emissions. For more efficient performance, a frame is divided into plural subfields, for example, 10 subfields. Each subfield comprises a reset period, an address period, and a sustain discharge period (also referred to as sustain period). In the reset period, an action is carried out to set all the cells to a uniform state, for example, a state in which wall charges are eliminated, regardless of the state of the cell whether ON or OFF in the preceding subframe. In the address period, a selective discharge (address discharge) is carried out to determine whether the cell is ON or OFF according to the display data, and wall charges to set a cell into the ON state are formed. In the sustain discharge period, a discharge is carried out repeatedly on the cell in which the address discharge is performed to emit a specified light. The length of the sustain discharge period, that is, the number of light emissions, differs from subfield to subfield. For example, an arbitrary gradation scale display can be attained by specifying the ratio of numbers of light emissions in the subfields 1 through 10 to 1:2:4:8 . . . , and making each cell emit light after selecting subfields according to the brightness of the cell for display.

FIG. 4 is a diagram that shows the light emission state of the reset discharge to illustrate the display contrast. To raise the display contrast, it is advisable to suppress the discharge intensity of the display cells for black display as much as possible. Therefore, it is preferable to prevent the discharge that does not have relation to display from occurring. The address discharge, however, may not be made to occur even if the specified voltage is applied between electrodes, if there is not a certain amount of suitable ions or metastable atoms. Therefore, the reset discharge is carried out in all the cells periodically. There are two methods to carry out the reset discharge in all the cells. One method is that, as shown in FIG. 4(A), a discharge of certain level is carried out when the first subfield at the top of a frame (or a field) is initiated, and in this case, the all the cells reset discharge is not carried out in the second subfield and latter ones. This has been disclosed in Japanese Patent No. 2756053. The other method is that, as shown in FIG. 4(B), a discharge of a small level is carried out in the reset period of all the cells. By using these methods, a display contrast of a ratio about 300:1 to 600:1 can be attained in a dark room. Concretely, the brightness is 1 cd/$m^2$ or less. Moreover, there may be another method, a combination of the two methods, that is, a reset with no or little light emission is carried out once in a frame or a field.

FIG. 5 is a diagram that illustrates the drive waveforms of the apparatus in FIG. 1, which is the example disclosed in Japanese Patent No. 2772753. In the reset period, a pulse of a high voltage, for example 300 V, greater than the discharge start voltage, is applied to the X electrode. By applying a pulse, a discharge is caused to occur in all the cells, regardless of the lighting state in the preceding subfield, and the wall charges are formed. When the pulse is removed, a discharge is caused to occur again by the voltage due to the wall charges themselves, but the space charges generated by the discharge are neutralized and a uniform state in which no wall charge exists can be established, because there is no voltage difference between electrodes. Although almost all charges are neutralized, a certain amount of ions and metastable atoms remains in the discharge space and works as a priming fire to cause the address discharge to occur without fail. This is called, in general, the pilot effect or the priming effect. In the address period, a scanning pulse is applied to the Y electrode, which is an electrode for scanning, and an address pulse is applied to the address electrode of the cell to be made to emit light and a discharge is caused to occur.

This discharge propagates to the X electrode side and wall charges are formed between the X electrode and the Y electrode. This scanning is carried out on all the display lines. Then, in the sustain discharge period, a sustain pulse of Vs voltage (about 170 V) is applied repeatedly. The cell on which wall charges are formed by the address discharge initiates a discharge, because the voltage of the wall charges are added to the sustain pulse voltage and the total voltage becomes more than the discharge start voltage. The cell in which no address discharge is caused to occur does not initiate a discharge because there is no wall charge on the cell.

FIG. 6 is a drive waveform chart in the subfield where no reset discharge of all cells is carried out, and each corresponds to SF2 to SF10, respectively, in FIG. 4(A). In the reset period, an erasing pulse of Vs voltage with a gradual slope is applied and a discharge is caused to occur only in the cell that emitted light, in the preceding subfield, to eliminate the wall charges. The actions in the address period and the sustain period are the same as those in FIG. 5. Therefore, the discharge that occurs in the reset period in this method is one that relates to the display data of the preceding subfield and the contrast is not degraded.

FIG. 7 is a diagram that shows the rough structure of the plasma display of another method disclosed in EP 0 762 373 A2. This method is called the ALIS (Alternate Lighting of Surfaces) method, in which the X electrodes and the Y electrodes, which are display electrodes, are spaced equally by turns and every slit between electrodes are used as a display line. Because every slit between electrodes is used as a display line, the number of electrodes is about half that in FIG. 2, therefore, this method has advantages in that the cost is reduced and the definition is improved.

FIG. 8 is a diagram that shows the principles of light emission. Because every slit between all the electrodes is a display line, it is impossible to light all the display lines at the same time. Therefore, an interlaced display, in which the lighting periods for the odd-numbered lines and the even-numbered lines are separated, is employed.

FIG. 9 is a diagram that shows the structure of a frame of the ALIS method, and a frame is divided into two fields and each field comprises plural subfields. In the first field the odd-numbered lines are used for display and in the second field, the even-numbered lines are used for display.

FIG. 10 is a diagram that shows the drive waveforms of the plasma display panel of the ALIS method disclosed in Japanese Unexamined Patent Publication (Kokai) No. 2000-75835. The reset period comprises a write period during which a weak write discharge is caused to occur by the first pulse with a gradual slope, and an erase period during which an erasing discharge is caused to occur by the latter pulse. Because these discharges are weak, the amount of emitted light is suppressed to a low level. Therefore, even if this reset discharge is carried out in all the cells of all the subfields, the brightness of black level is never raised. This corresponds to the situation in FIG. 4(B).

As described above, the brightness of black display of the plasma display panel is suppressed to a low level by improving the drive waveforms and the sequence, and the contrast ratio in a dark room is accomplished to 300:1 to 600:1. Also white brightness 600 cd/m$^2$ is accomplished in a small area, but an optical filter whose light transparency is 50 to 60% is provided in the display apparatus that is used actually, to prevent the contrast in a light room from deteriorating because of the deflection of outside light on the panel surface. Although the panel itself has a brightness of 600 cd/m$^2$, that after the passing through the filter becomes to 300 cd/m$^2$ or so. For a CRT type TV sold commercially, the peak brightness is about 500 cd/m$^2$, and a higher brightness is required for the plasma display. To meet these demands, fluorescent materials for a higher brightness have been developed and applied, but this results in an increase in the brightness of the black level. In the case where the dark room contrast is 500:1 and the peak brightness is 500 cd/M$^2$ with a filter attached, the brightness of black level becomes 1 cd/M$^2$. When a movie is viewed in a situation close to a dark room, 1 cd/m$^2$ is too bright and the degradation of the display cannot be ignored.

Moreover, there is an example in which a dark room contrast of about 3000:1 is achieved on the panel that has the cell structure as shown in FIG. 2 by carrying out the reset method only once to the frame or field as shown in (A) after applying the reset method in which weak light is emitted as shown in FIG. 4(B). But it is restricted to the panel that has a cell structure in which the distance between neighboring cells are large as shown in FIG. 2, therefore, such method cannot be simply realized on the ALIS method panel. The reason is described below with reference to FIGS. 11A through 11D and FIGS. 12A through 12D.

FIGS. 11A through 11D are diagrams that show the examples of the discharge conditions when the plasma display panel of ALICE method is operated with the drive waveforms in FIG. 10 and a large voltage as shown in FIG. 4 (A) is applied between the X electrode and the Y electrode. FIG. 11A is a diagram that shows the case where a sustain discharge is carried out in a cell formed by X2 and Y2 in the immediately preceding subfield. In this case, the electrons generated by the sustain discharge diffuse as far as X3 and Y1, which are neighboring electrodes, and are accumulated as wall charges. In the case of the conventional plasma display panel shown in FIG. 2, such accumulation of electrons on the neighboring electrodes does not occur because the distance between the Y1 electrode and the X2 electrode, and that between the Y2 electrode and the X3 electrode are great. Then, in the reset period, an erasing pulse of negative 100 V with a gradual slope is applied to the X electrode, and the wall charges are decreased by the erasing discharge between X2 and Y2 with t1 timing as shown in FIG. 11B. Then a write pulse of voltage Vs (170 V) is applied to the Y electrode and a discharge is caused to occur again as shown in FIG. 11C. The voltage between the X electrode and the Y electrode at this time is 270 V and exceeds the discharge start voltage (about 220 V), therefore, wall charges are formed. Wall charges are formed in all the cells and, subsequently, with the voltage of the X electrode being fixed to 70 V (Vx), an erasing pulse with a gradual slope that reaches as low as negative 150 V is applied to the Y electrode. This pulse causes a discharge to occur again, but because the final voltage of the erasing pulse is the same as the discharge start voltage, almost all the wall charges are neutralized at the end and a state in which almost no wall charges exist can be realized in all the cells, as shown in FIG. 11D.

Next, the reset period in which reset is carried out in the second and latter subfields is considered. FIGS. 12A through 12D are diagrams that show examples of discharge action in this case, and the voltage applied to the X electrode is changed from negative 100V to 0 V with the timing shown in FIG. 12C to carry out discharge only in cells lit in the preceding subfield to perform erasing. In this case, if the wall charges on X2 and Y2 have the polarity that increases the voltage between electrodes, the cell discharge occurs between X2 and Y2 and wall charges are eliminated. The negative charges remaining on X3 also increase the voltage between electrodes, therefore, an erasing discharge is caused to occur between the X3 and Y3 electrodes and charges are neutralized. The negative charges remaining on the Y1 electrode, however, remain because the negative charges have a polarity that cancels the applied voltage and no discharge is caused to occur. Therefore, after the reset period is completed, negative charges remain on the Y electrode. If such residual wall charges exist, a scanning pulse is applied in the address period and a discharge may be caused to occur even if no address pulse is applied, resulting in an unstable performance.

In addition, in the case in which such reset action as shown in FIG. 4(B) is carried out, it is possible to suppress the intensity of light emission caused by the reset discharge by decreasing the negative voltage applied to the X electrode with the timing t2 in FIG. 10. FIG. 13 is a diagram that shows the relation between the voltage of reset discharge and the brightness attained by the reset discharge. As shown in FIG. 13, for example, it is possible to lower the brightness by decreasing the voltage between the X and Y electrodes to be applied with the timing t2 in FIG. 10. It is found, however, that the reset action becomes insufficient for the stable display when the voltage drops below 260 V. An example case is where the voltage to be applied to the Y electrode is Vs =170 V, and the negative voltage to be applied to the X electrode is 90 V or lower. In this case also, the negative charges that remain on the Y electrode cancel the applied voltage, therefore, the reset discharge cannot be carried out sufficiently.

Taking these phenomena into consideration, if the negative voltage to be applied to the X electrode is set to around 100 V and the brightness is set to 1.2 cd/m$^2$, a contrast of 500:1 is attained.

In addition, a method, in which narrow reset pulses are used in the PDP of the ALIS type and the reset discharge is carried out in a lit cell and the cell contiguous thereto, has been disclosed in Unexamined Patent Publication (Kokai) No. 11-338414. In this method, the reset discharge is carried out only in the lit cell and the adjacent cell, therefore, there is no light emission for black display and the dark room contrast is excellent. However, whether or not the reset discharge can be carried out in the cell contiguous to the lit cell depends on the pulse width and voltage, therefore, it used to be very difficult to cause a discharge to occur stably in all the cells that have variations in characteristics such as the discharge start voltage.

As explained above, the problem is that a sufficient contrast cannot be attained under the conditions in which stable actions are ensured in the PDP of the ALIS type.

In the case of a CRT, a situation in which 0 cd/M$^2$ is almost reached has been realized, and the same accomplishment in a plasma display panel is eagerly expected, as well as in the case of a PDP of ALIS type.

SUMMARY OF THE INVENTION

The object of the present invention is to realize a method of driving a plasma display panel of the ALIS type, in which the brightness of light emission for black display is lowered, performance is stable, and the contrast is very high.

In order to attain the above-mentioned object, the method of driving a plasma display panel of the ALIS type of the present invention is characterized in that even when a voltage, which changes gradually as time goes by, is applied between the first and the second electrodes to cause a discharge to occur only in the cell lit in the preceding subfield, a neighboring cell write period, during which the residual wall discharges on one side of the electrode of the different display line contiguous to the cell lit in the preceding subfield are eliminated, is provided before or after the write period.

According to the present invention, when the conventional drive method is carried out, the wall discharges remaining on one of the electrode of a different display line, contiguous to the cell that was lit in the preceding subfield, are eliminated. The wall charges remaining on the other electrode of the display line are eliminated at the same time when the wall charges in the cell that was lit in the preceding subfield are eliminated, as is conventional. Therefore, the present invention realizes a state in which almost no wall charge exists on all the cells. Moreover, the discharge caused by elimination is very weak and the degradation of the contrast is small.

The neighboring cell write action is carried out to eliminate the wall charges, which leaked and were accumulated by being contiguous to the cell that was lit and were not eliminated by a small applied voltage, because the polarity of the applied voltage is reverse and no reset discharge is caused to occur in the write period. The wall charges generated in the neighboring cell write period do not affect the write period, therefore, it can be carried out before or after the write period.

As shown in FIG. 4(A), when a frame (or a field) is composed of plural subfields and charged particles and metastable atoms are generated to keep the conditions under which discharge is easily caused to occur (priming effect or pilot effect), by applying a large voltage only to the top subfield of a frame to carry out the reset discharge with a strong intensity of light emission on all the cells, the present invention is applied to the reset period of other subfields. Particularly in the case of the ALIS method, the interlaced drive as shown in FIG. 9 is carried out, and it is acceptable in this case that the reset discharge in all the cells is carried out in the top subfield of the first frame, that is, the first field, and the present invention is applied to the reset periods in other subfields, or that the reset discharge in all the cells is carried out in the top subfields in the first and the second fields, and the present invention is applied to the reset periods of other subfields. When the reset discharge in all the cells is carried out in the top subfields of the first and the second fields, the subsequent actions can be carried out stably because the part that is not used in the preceding field is activated. In the case in which the reset discharge in all the cells is carried out only in the top subfield of the first field, the brightness during black display is nearly halved.

It is advisable to further provide an erase period, in which an address prepare voltage waveform with a gradual slope is applied so that the voltage between the first and the second electrodes becomes greater than the discharge start voltage, after both the write period and the neighboring cell write period are carried out.

Moreover, in the PDP with surface discharge of three electrodes, the discharge start voltage between the address electrode and the Y electrode is lower in general compared to that between the X electrode and the Y electrode, but a discharge toward the third electrode with a voltage exceeding the discharge start voltage never occurs because the voltage applied to the third electrode is selected between the maximum and the minimum voltages applied to the first and the second electrodes.

BRIEF DESCRIPTION OF THE DRAWINGS

The present invention will be more clearly understood from the description, as set below, with reference to the accompanying drawings, wherein.

DESCRIPTION OF THE PREFERRED EMBODIMENTS

Before the description of the embodiments of the present invention, the basic operation principles are described with reference to FIG. 14A through FIG. 14D.

FIG. 14*s* are diagrams that illustrate the discharge actions when the drive method of the present invention is carried out, in which the neighboring cell write period is carried out before the write period and the erase period is carried out, after the write period.

Figure 14A:
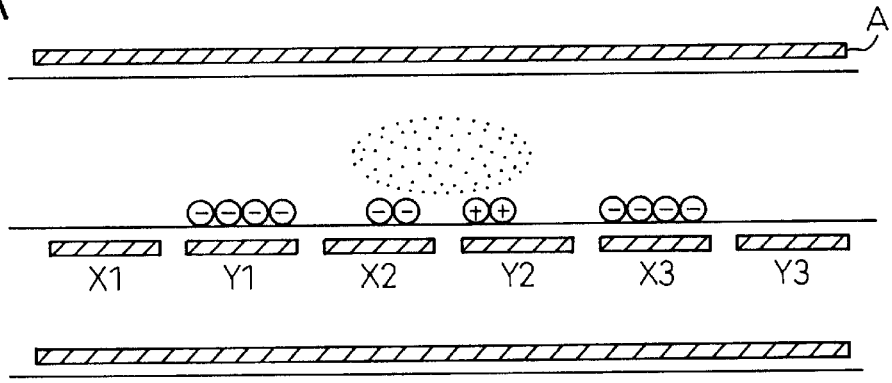
FIGS. 14A through 14D are diagrams that describe the reset action of the present invention.

As shown in FIG. 14A, when a sustaining discharge is repeated in the cell between X2 and Y2 in the sustain discharge period of the preceding subfield, electrons fly to the Y1 and X3 electrodes and accumulate. In the early stage of the reset period, the wall charges between X2 and Y2 are decreased by the erasing discharge.

Figure 14B:
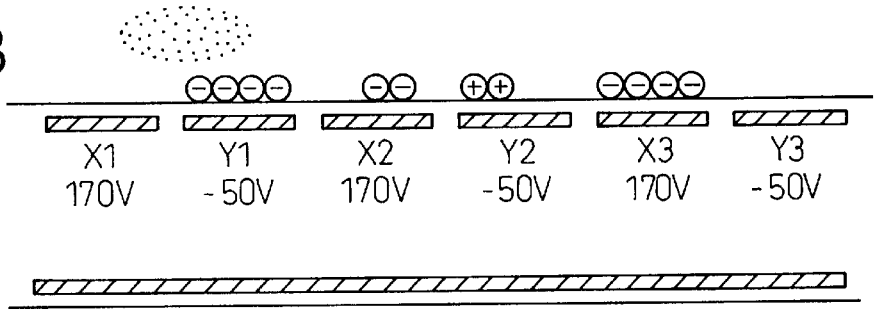

Next, as shown in FIG. 14B, when a voltage of 170 V is applied to the X electrodes and negative 50 V to the Y electrodes, negative charges on Y1 are superposed on the applied voltage and the discharge start voltage is exceeded, resulting in a discharge. Because this voltage is applied with a sufficiently gradual slope, a large-scale discharge is not caused to occur, the wall charges are eliminated gradually by the discharge, and a state in which almost no wall charge exists on the Y1 electrode is realized at the end of pulse. At this time, because the voltages between X2 and Y2 cells, and X3 and Y3 cells are lowered by the wall charges, the discharge start voltage is not reached and a discharge is not caused to occur. Similarly, because wall charges are not accumulated on the cells that were not lit in the preceding subfield or the cells contiguous thereto, no discharge is caused to occur.

Figure 14C:
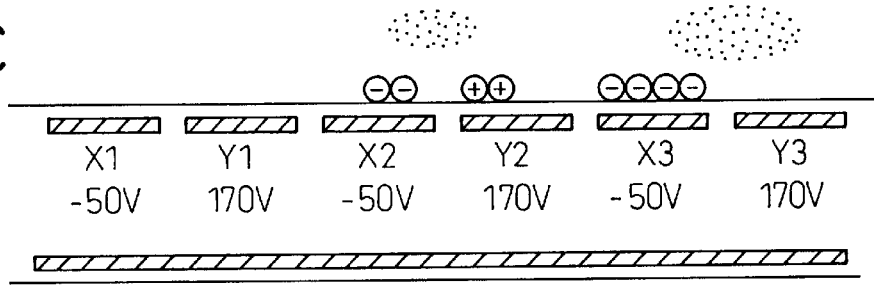
Figure 14D:
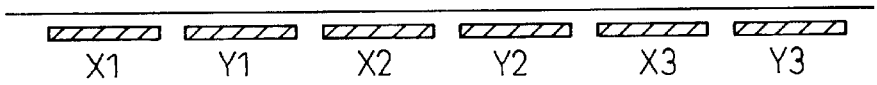

Next, as shown in FIG. 14C, when a voltage of 170 V is applied to the Y electrode and negative 50 V to the X electrode, the wall charges are superposed on the applied voltage, the voltages between X2 and Y2 cells, and X3 and Y3 cells exceed the discharge start voltage and a discharge is caused to occur. Because this voltage is applied with a sufficiently gradual slope, a large-scale discharge is not caused to occur, the wall charges are eliminated gradually by the discharge, and a state in which almost no wall charge exists in all the cells is realized at the end of pulse. At this time, no wall charge is accumulated on the cells that were lit in the preceding subfield and the cells contiguous thereto, therefore, no discharge is caused to occur. A uniform state, as shown in FIG. 14D, is realized in which no wall charge exists in all the cells.

Figure 15:
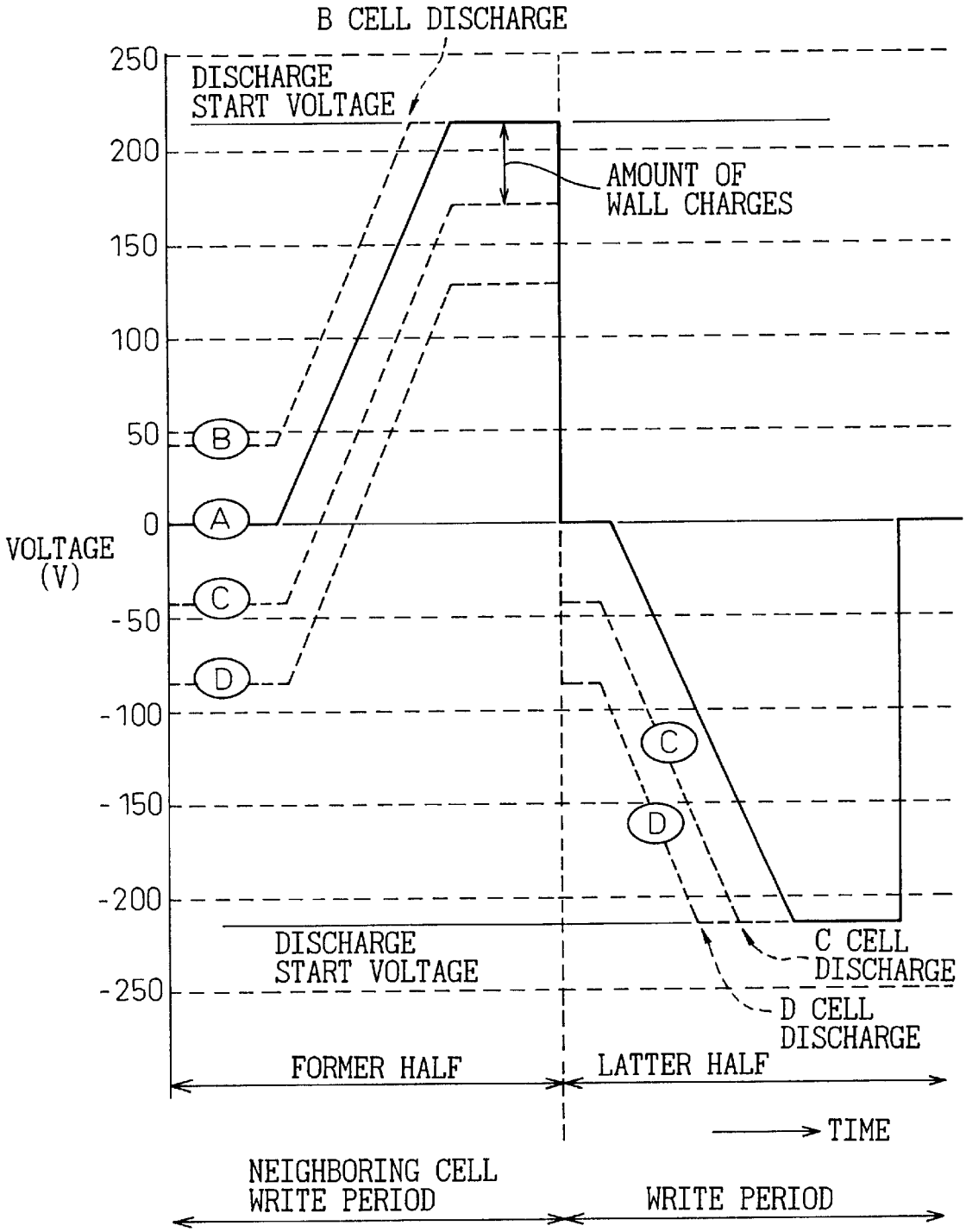
FIG. 15 is a diagram that shows the relation between the applied voltage and the amount of wall charges in the reset action of the present invention.

These actions are further described with reference to FIG. 15. The vertical axis indicates the cell voltage and the discharge start voltage is shown at the points of positive 220 V and negative 220 V. The reason why both positive and negative voltages exist is because the positive voltage indicates when the X electrode becomes an anode, and the negative voltage, when the X electrode becomes cathode. The solid line "A" indicates the applied voltage between the X electrode and the Y electrode, and also indicates a voltage waveform with a gradual slope used in the reset period. The dotted line indicates the cell voltage when the wall voltage due to the wall charges is added to the applied voltage. The difference between the solid line and the dotted line indicates the voltage due to the wall charge. The early stage of the dotted line B indicates the cell voltage of X1–Y1 in the state of FIG. 14A, and when the voltage of the Y electrode is regarded to be 0 V because electrons exist on the Y electrode, the wall charges of, for example, 40 V exists on the X side. As a voltage is applied gradually, and when the cell voltage exceeds the discharge start voltage, discharge is caused to start. When charges are generated by a discharge and attracted to the electrode side, part of wall charges are neutralized and the cell voltage drops. When the voltage is raised a little higher, a discharge is caused to occur again, charges are generated thereby and attracted to the electrode side, part of the wall charges are neutralized and the cell voltage drops. As the above-mentioned actions are repeated, the wall charges are decreased. When the applied voltage becomes equal to the discharge start voltage, the amount of wall charges becomes almost zero, and when the voltage stops increasing, a state in which almost no charge exists is realized.

Next, the latter half is described. The cell indicated by the dotted line C is one in the early stage in FIG. 14A, indicating the cell voltage of X3–Y3, and there exist electrons equivalent to negative 40 V on the X electrode side. The case where a certain amount of wall charges exists in the cell of X2–Y2 is indicated by the dotted line D. Although the application of voltage in the former half is carried out with the X electrode being regarded to be positive polarity, the discharge start voltage is not exceeded because the wall voltage has the opposite polarity and lowers the applied voltage. The application of voltage in the latter half is carried out with the X electrode being cathode, the Y electrode, anode, and with a voltage waveform that has a gradual slope. In this case, in the cell in which negative wall charges are formed on the X electrode and a discharge is not caused to occur in the former half, a discharge is caused to occur when the sum of the applied voltage and the wall voltage exceeds the discharge start voltage because the wall voltage is superposed on the applied voltage, the generated charges neutralize the wall charges and a discharge is caused to occur when the voltage get higher, and these actions are carried out repeatedly. When the applied voltage becomes equal to the discharge start voltage finally, the amount of wall charges becomes almost zero, and a state with no wall charge can be realized if the application of voltage is terminated when such state is reached. This is described by the dotted lines C and D.

Figure 10:
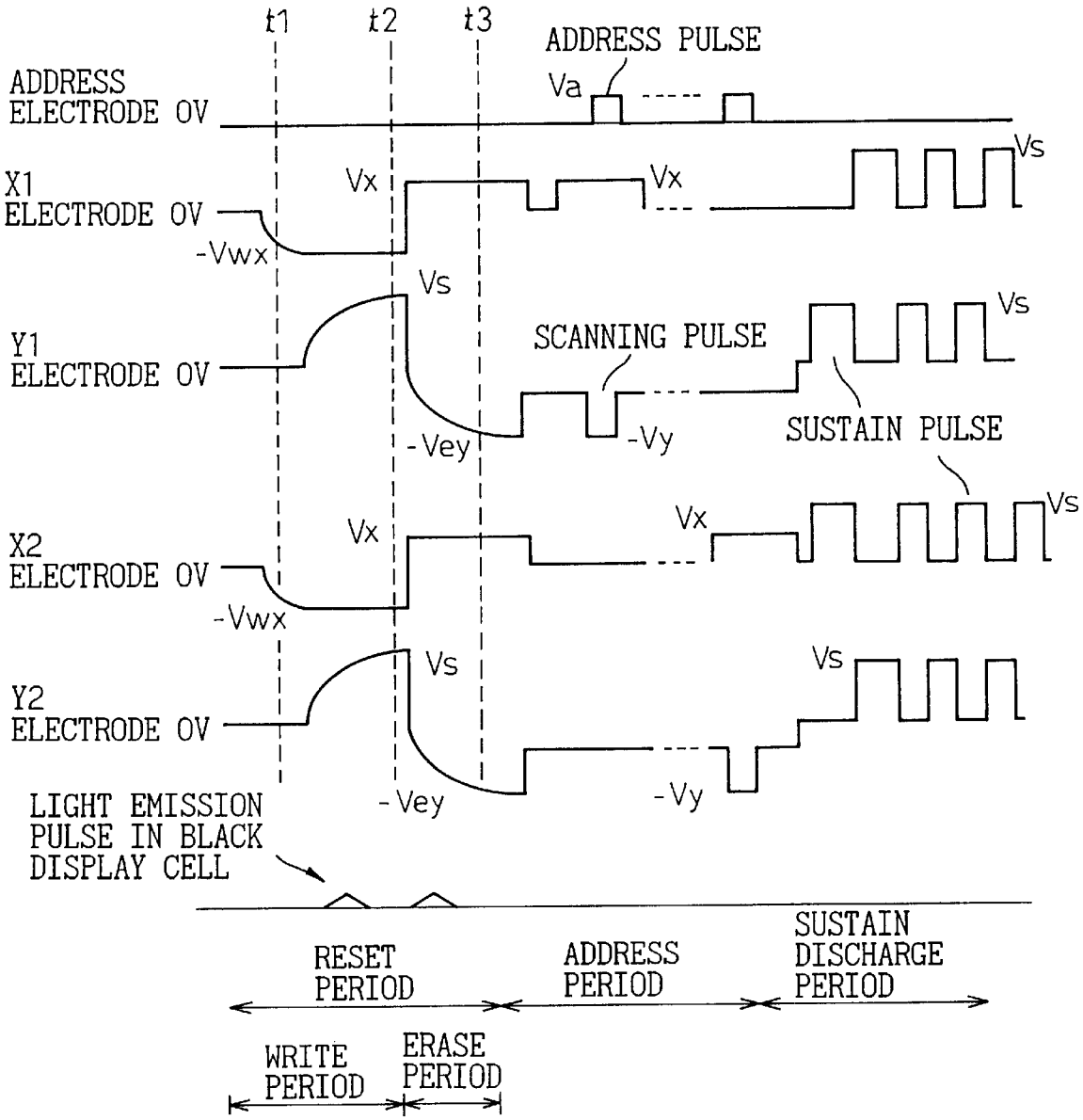
FIG. 10 is a waveform chart that shows the drive waveforms of the plasma display panel using the ALIS method.
Figure 11A:
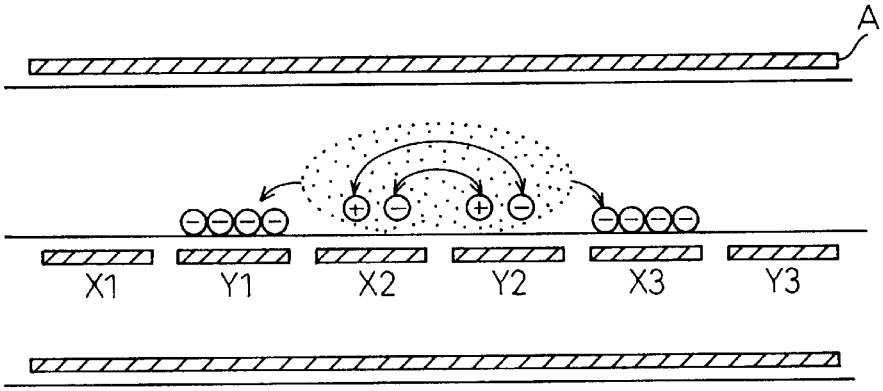
FIGS. 11A through 11D are diagrams that show the reset action in the plasma display panel using the ALIS method.
Figure 11B:
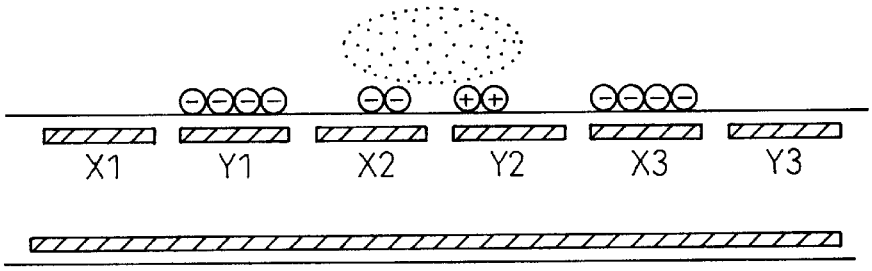
Figure 11C:
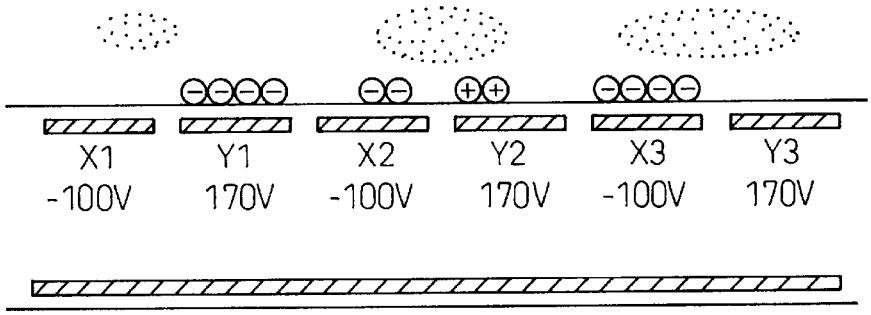
Figure 11D:
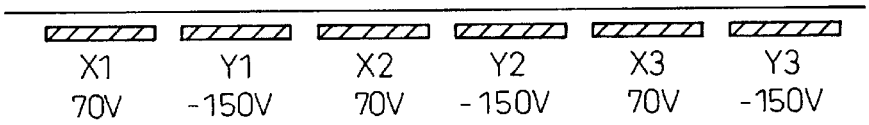
Figure 12A:
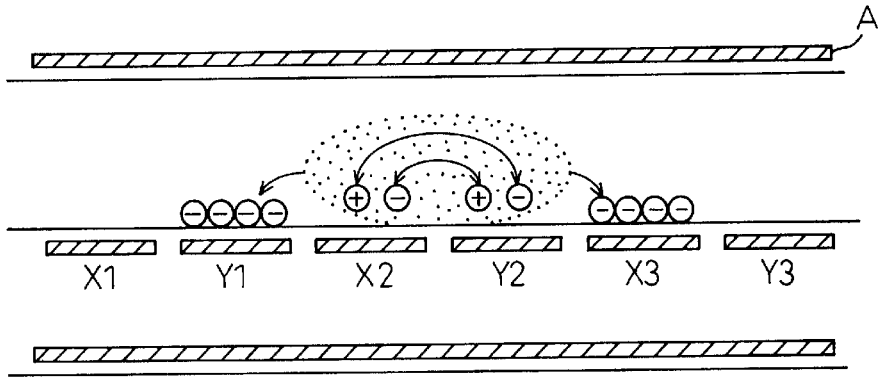
FIGS. 12A through 12D are diagrams that describe the problem in that the cells, which were lit in the preceding subfield are reset selectively, in the plasma display panel using the ALIS method.
Figure 12B:
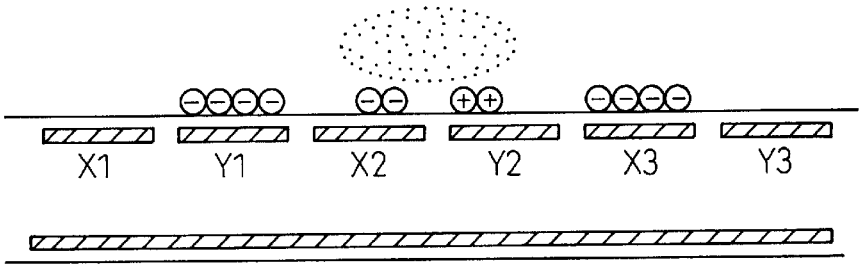
Figure 12C:
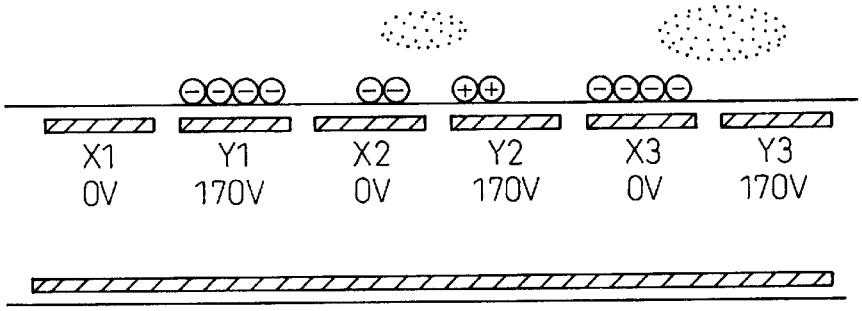
Figure 12D:
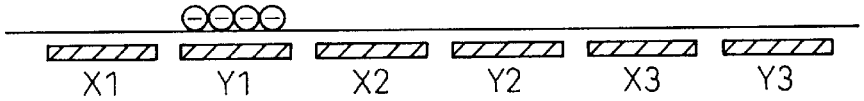
Figure 13:
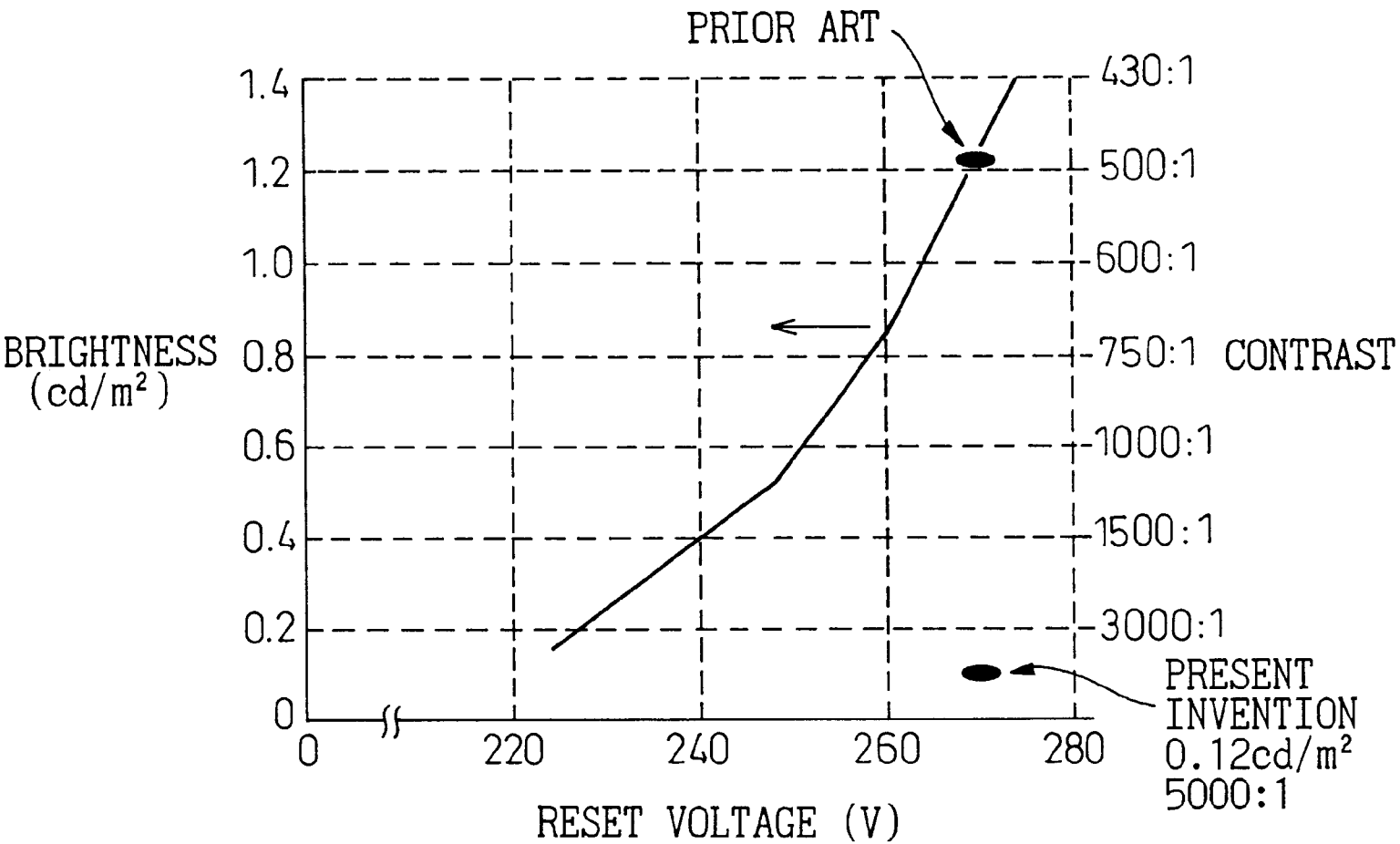
FIG. 13 is a diagram that shows the relation between the reset discharge and the brightness.
Figure 16:
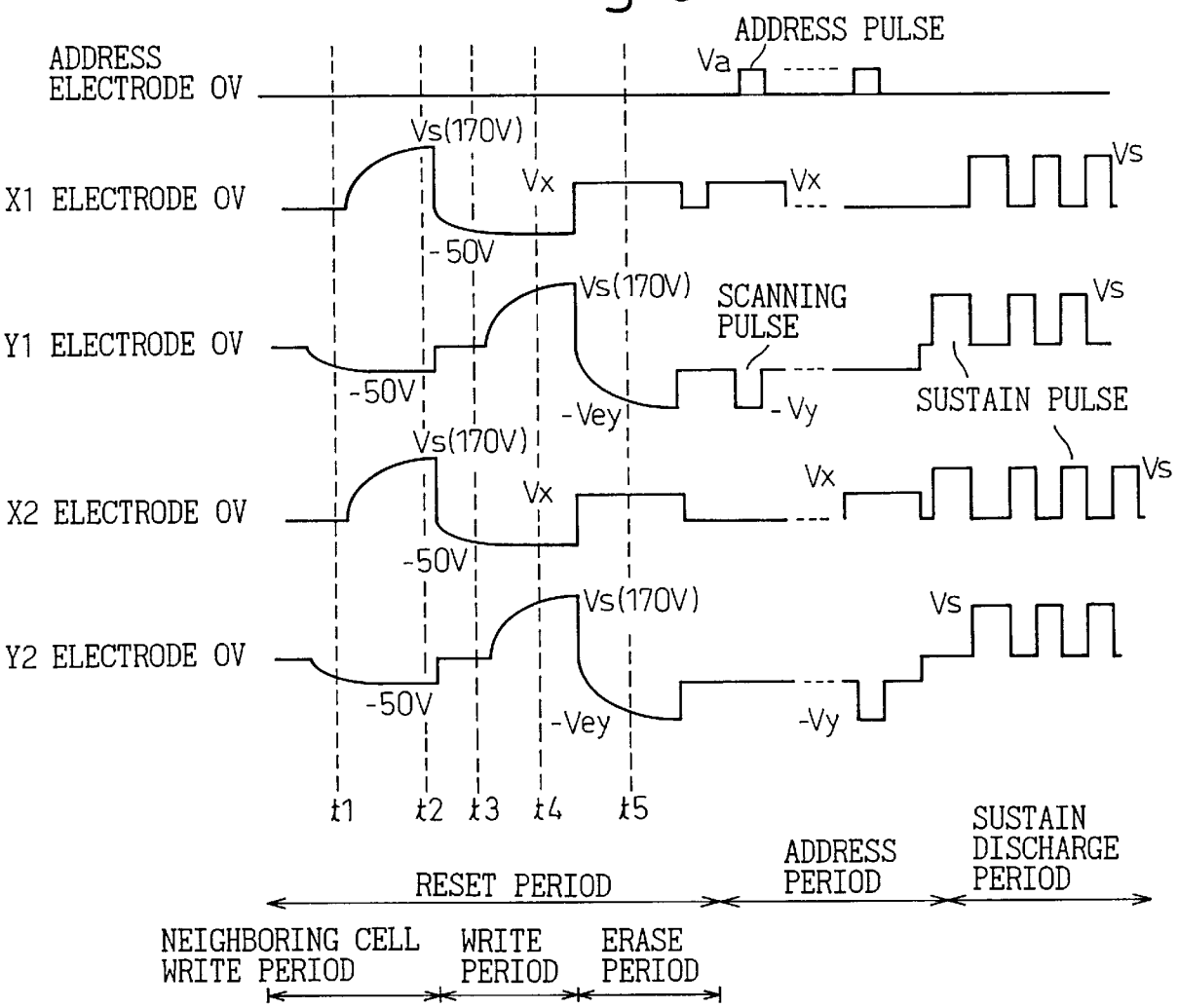
FIG. 16 is a diagram that shows the drive waveforms of the apparatus in the first embodiment of the present invention.

FIG. 16 is the drive waveform chart of the ALIS type PDP in the first embodiment of the present invention. As obvious if compared to the drive waveform in FIG. 10, the difference exists in that the neighboring cell write period is provided before the write period in the reset period. In the early stage of the reset period (neighboring cell write period), a voltage of negative 50 V with a gradual slope is applied to the Y electrode (t1). This waveform eliminates part of the wall charges in the cell that was lit in the preceding subfield. Then, a voltage waveform of 170 V with a gradual slope is applied to the X electrode (t2). At this time, a discharge is caused to occur in the cell contiguous to the lit cell, in which electrons are accumulated on the Y electrode, that is, the X1–Y1 cell in FIG. 14. A state in which almost no wall charge exists on the Y1 electrode can be realized by this discharge, because the final voltage becomes 220 V (170 V+50 V), that is, equal to the discharge start voltage. Then, in the process from t3 to t4 in the write period, a discharge is caused in the X2–Y2 cell that was lit in the preceding subfield and the cell contiguous thereto, in which electrons are accumulated on the X electrode, that is, in the X3–Y3 cell in FIG. 14C, and if the application of voltage is terminated when the applied voltage becomes equal to the discharge start voltage, a state in which almost no wall charge exists can be realized.

Then, the wall charges that are not eliminated by the actions so far are eliminated in the erase period t5. This prevents the address discharge from occurring in the state in which an address pulse is not applied during address discharge. In other words, if excessive positive charges are accumulated on the address electrode, there may be a case in which a discharge is caused to occur when a scanning pulse is applied to the Y electrode without the application of an address pulse, but the wall charges on the address electrode are removed by the discharge in the erase period to prevent this. Moreover, because the voltage of the address electrode is 0 V in the sustain discharge period, positive charges are accumulated. At t2 and t4 also, positive charges are apt to accumulate because the address electrode is 0 V. In other words, while the main object of the discharge from t1 to 4t4 is to eliminate charges between the X electrode and the Y electrode, that of the discharge in t5 is to eliminate the wall charges between the address electrode and the Y electrode.

Further, after the measurement of the discharge start voltage of the panel is carried out, the applied voltage during reset is set so as to be equal to the discharge start voltage. If the variations in voltage are large from panel to panel, it is advisable to measure the voltage for each panel and set a voltage individually. It may be required, however, to set to a fixed value for production efficiency. In this case, it is not acceptable if the voltage is set to one that exceeds the discharge start voltage, because the reset discharge is caused to occur in all the cells even for the black display. Taking this into account, it may be the case where a lower voltage is set to prevent the set voltage from exceeding the discharge start voltage. Because there exist variations in discharge start voltage for a single panel, it may be the case where a lower voltage is set. Therefore, because the residue of the wall charges may be expected during the process from t1 through t4 in the panel or cell with a high discharge start voltage, the process of t5 for elimination will be important in order to prevent malfunctions in the address period in such case.

In the general three-electrode surface discharge PDP, the discharge start voltage between the address electrode and the Y electrode is as low as 180 V to 200 V when the discharge start voltage between the X electrode and the Y electrode is around 220 V. In the present embodiment, however, because a voltage of 0 V is applied to the address electrode during the reset period, and such voltage is between the minimum and the maximum of the voltage to be applied to the X and Y electrodes, the discharge start voltage is not exceeded and no discharge is caused to occur.

In the present embodiment, after an initialization is carried out with a waveform of less than the discharge start voltage in the neighboring cell write period and the write period, the erase period is provided. In this erase period, an address discharge is carried out after an address prepare voltage waveform of the voltage— Vey and Vex with a gradual slope is applied. If the applied voltages of— Vey and Vex are set between 220 V and 250 V, which is greater than the discharge start voltage, a sufficient elimination can be carried out in the erase period, even though charges are not eliminated sufficiently in the preceding neighboring cell write period and the write period. In this case, a certain amount of positive charges is accumulated on the Y electrode side. For the black display in which an address discharge or a sustain discharge is not performed, the process proceeds to the early stage of the reset period in the next subfield as is, but no discharge is caused to occur because the voltage waveform whose anode is the Y electrode is set low enough. In the subsequent subfields, a discharge is not caused to occur in the reset period even if the black display lasts. Moreover, if the voltage — Vey, which is applied to the Y electrode in the erase period, is set to +10 V with respect to the voltage— Vy of a scanning pulse, the amount of positive charges that remain on the Y electrode can be reduced and the address discharge is made more surely to occur with a lower voltage.

If the voltage which is applied to the address electrode in the erase period is set to a voltage in the non-selected state in the address period, and the voltage which is applied to the X and Y electrodes in the erase period is set to a voltage in the selected state in the address period, malfunctions can be prevented from occurring in the address period.

Moreover, if the voltage, which is applied to the X and Y electrodes in the write period and the neighboring cell write period, is set between the minimum and the maximum of the sustain discharge pulse to be applied to the X and Y electrodes in the sustain discharge period, no discharge is caused to occur in the cell in which address discharge is not caused to occur in the sustain discharge period, even if a certain amount of charges remain in the reset period.

Figure 1:
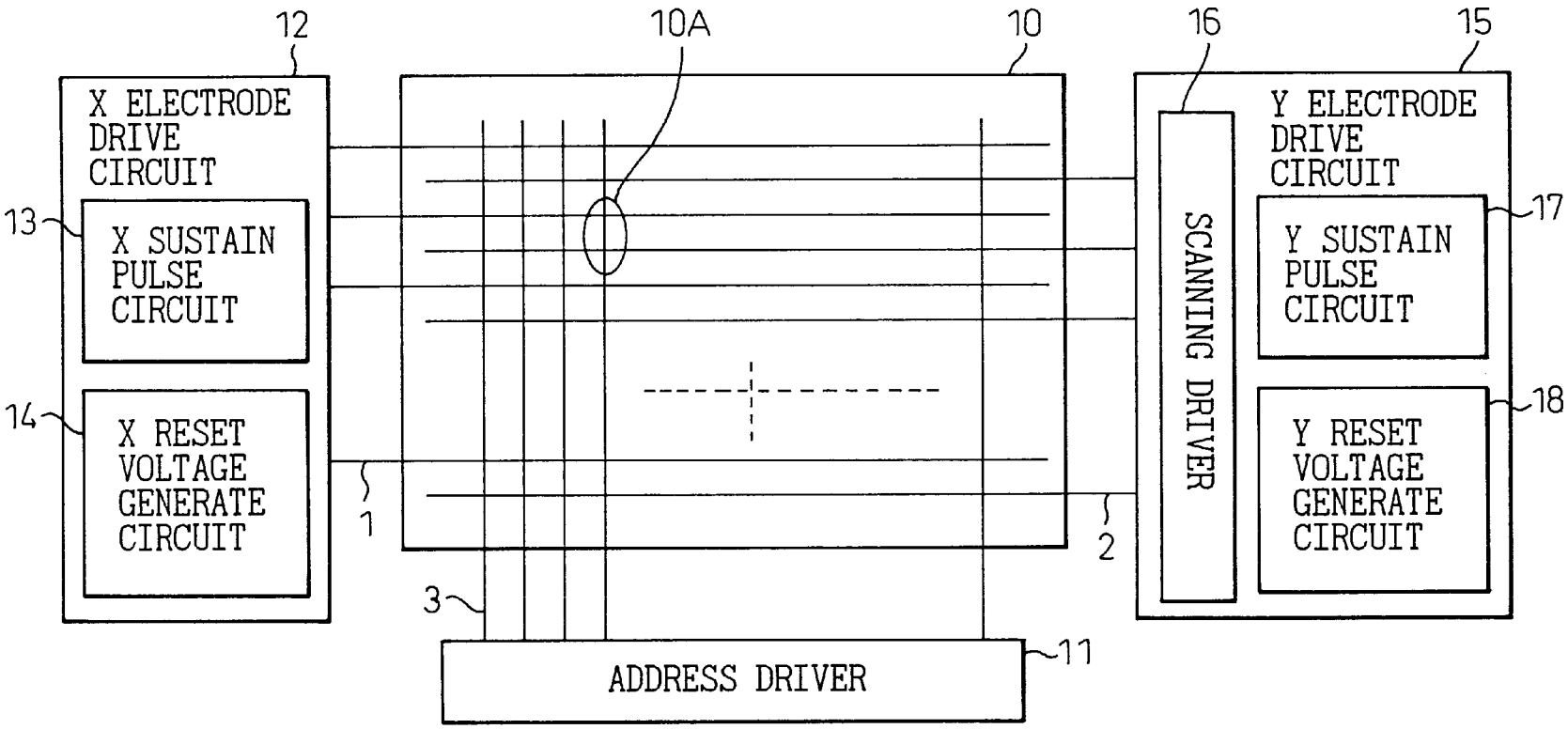
FIG. 1 is a diagram that shows a structure of a display apparatus employing a plasma display panel.
Figure 2:
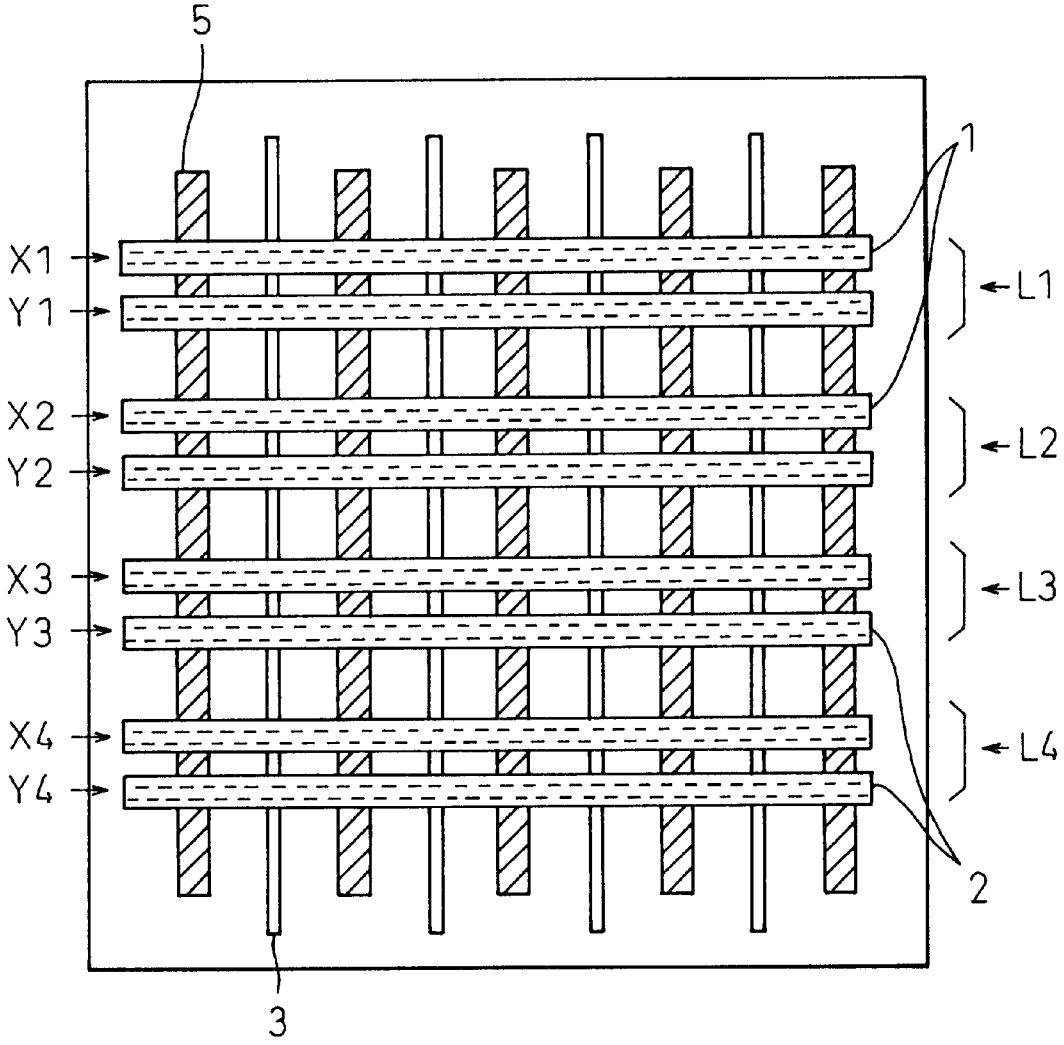
FIG. 2 is a diagram that shows a structure of a plasma display panel.
Figure 3:
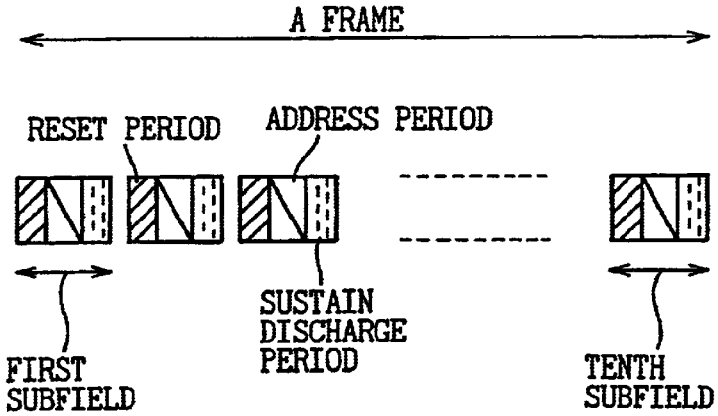
FIG. 3 is a diagram that shows a frame structure to establish the gradation display in a display apparatus employing a plasma display panel.
Figure 4:
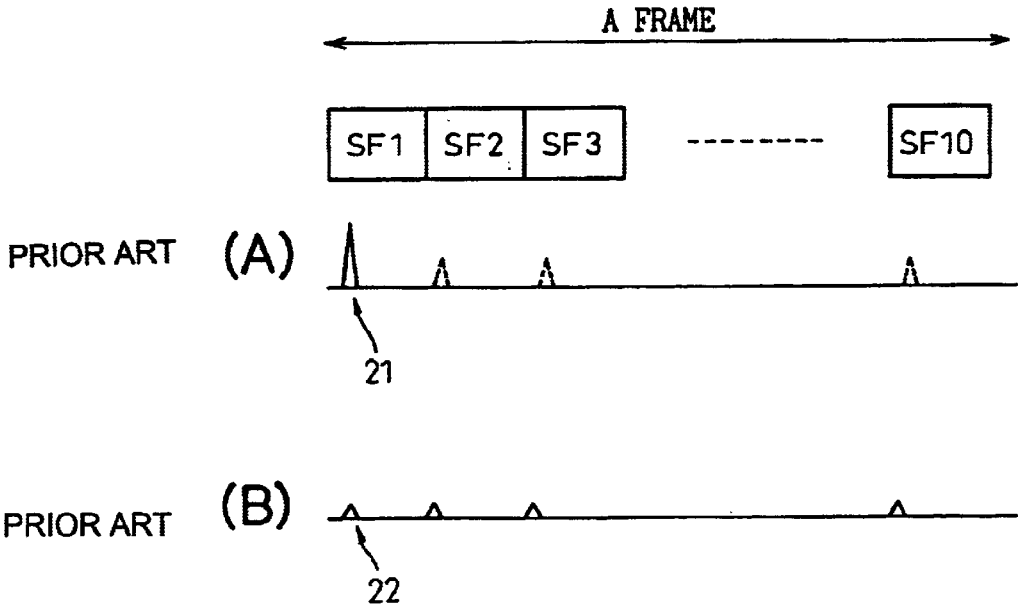
FIGS. 4(A) and 4(B) is a diagram that shows an example of light emission by the reset discharge of the conventional art.
Figure 5:
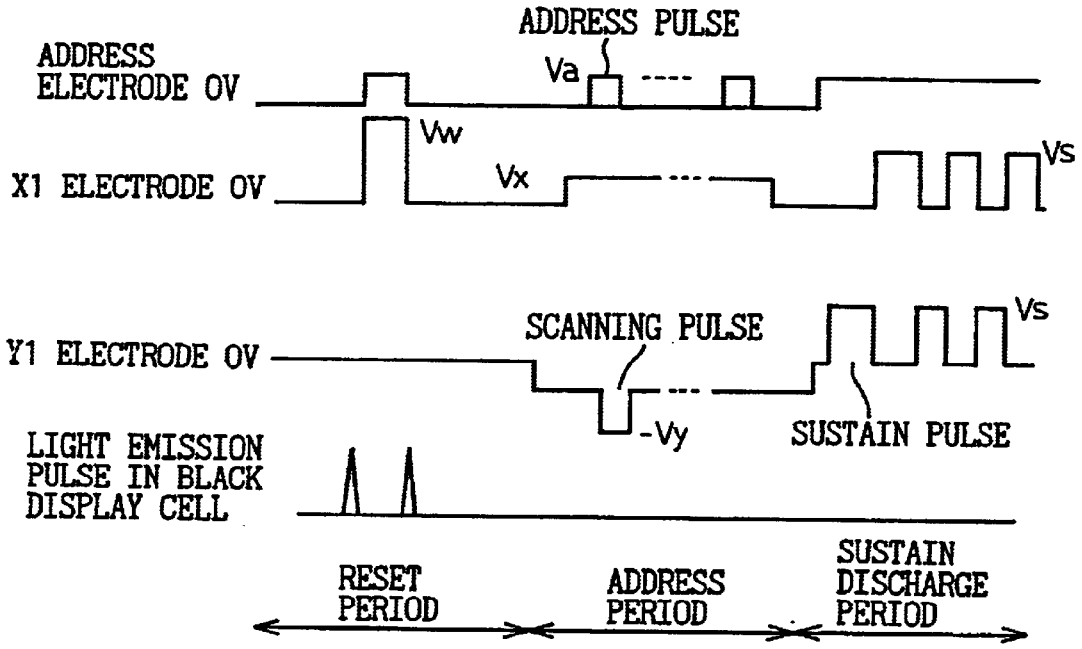
Fig.5 PRIOR ART
FIG. 5 is a waveform chart that shows drive waveforms of the conventional art in the display apparatus in FIG. 1.
Figure 6:
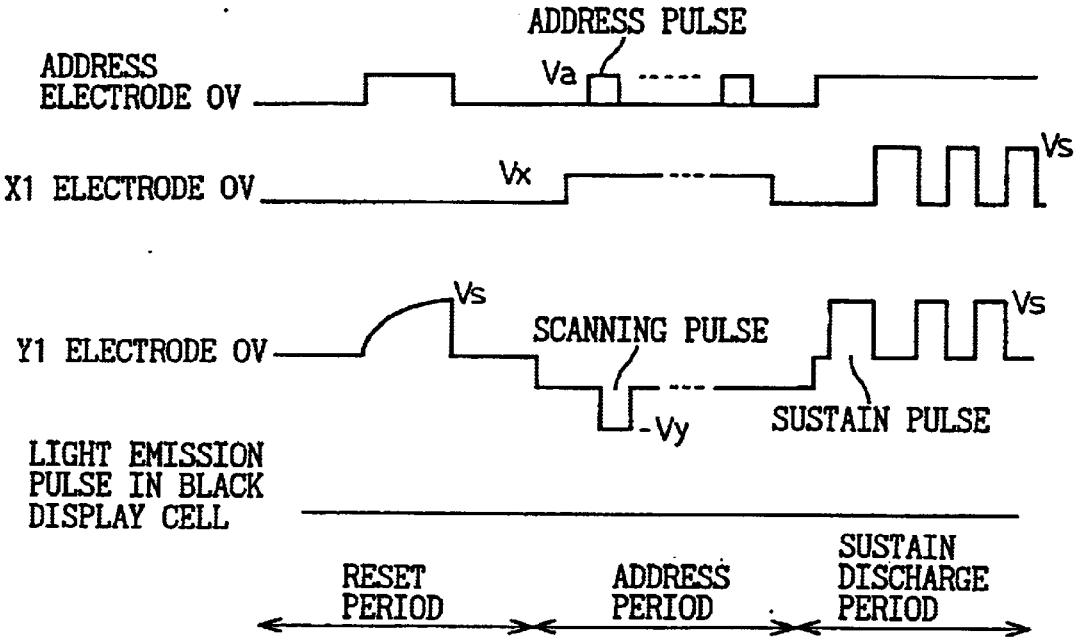
Fig.6 PRIOR ART
FIG. 6 is a waveform chart that shows other drive waveforms of the conventional art.
Figure 7:
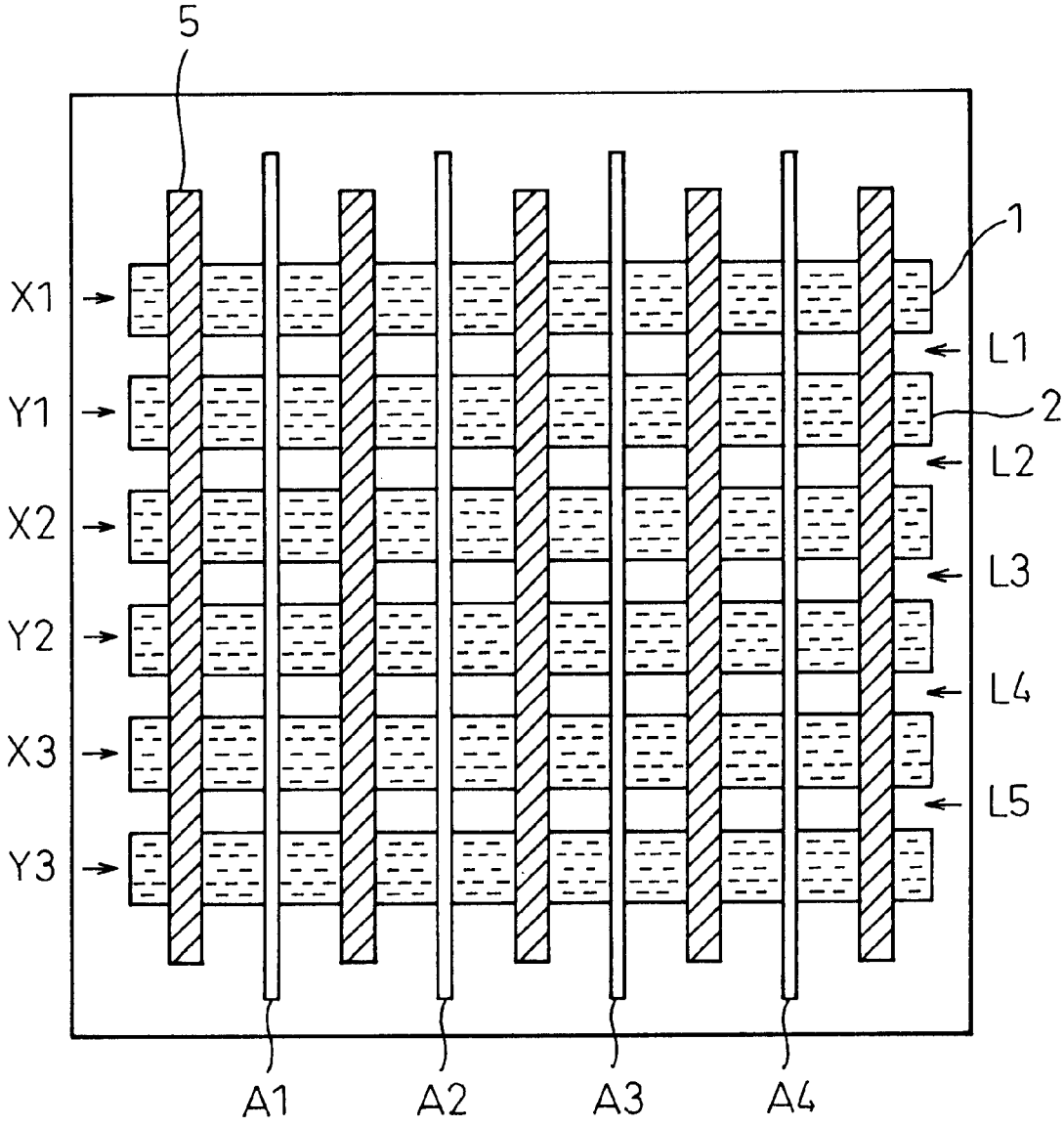
FIG. 7 is a diagram that shows a structure of the plasma display panel using the ALIS method to which the present invention is applied.
Figure 8:
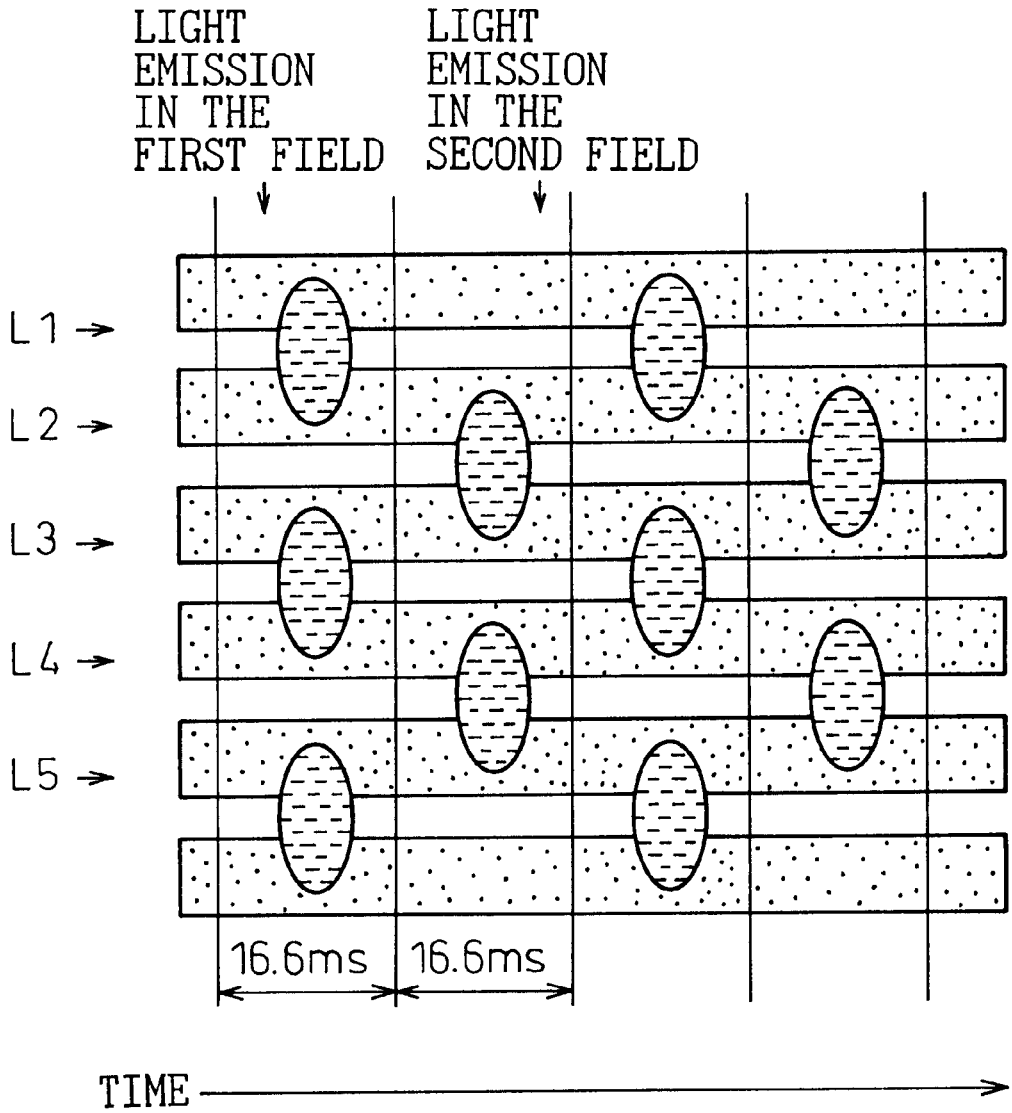
FIG. 8 is a diagram that shows the interlaced drive in the plasma display panel using the ALIS method.
Figure 9:
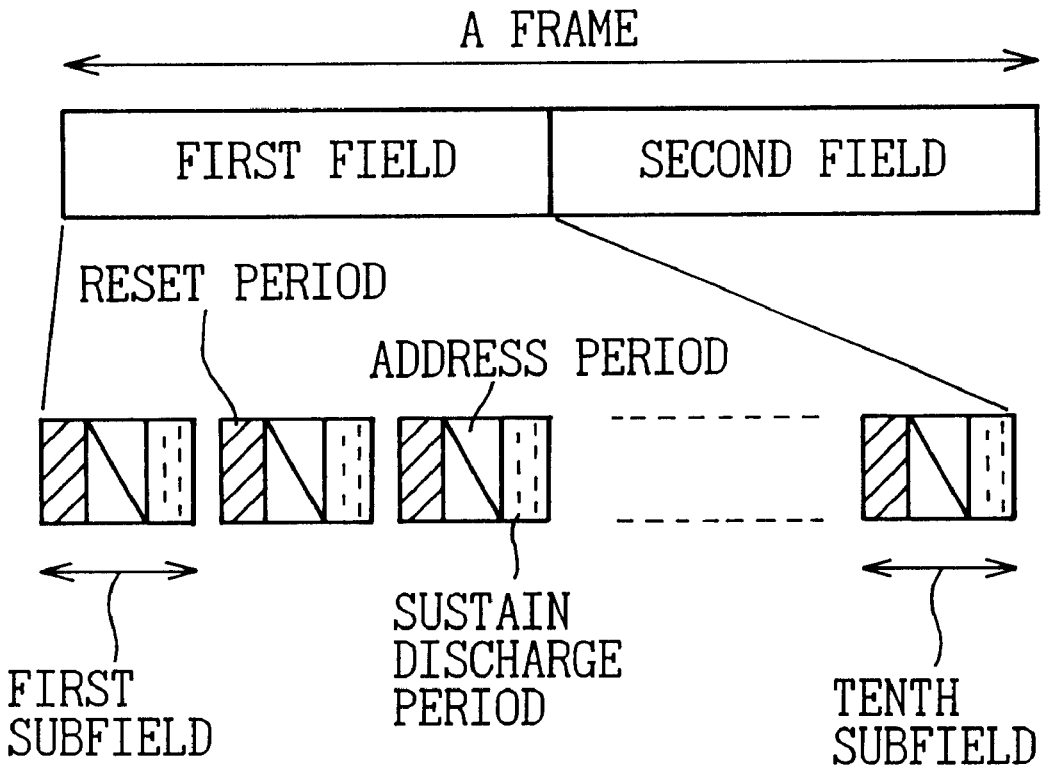
FIG. 9 is a diagram that shows the frame structure for the interlaced drive of the plasma display panel using the ALIS method.

Moreover, in the frame structure as shown in FIG. 9, it is possible to design so that the neighboring cell write period is not carried out in the subfields whose sustain discharge period is short, instead the neighboring cell write period is carried out in the subfield whose sustain discharge period is long, because the amount of electrons that diffuses to the cell contiguous to the lit cell is small in the subfield whose sustain discharge period is short and in which the number of times the sustain discharge is repeated is small. This will abbreviate the drive time.

If the voltage, which is applied between the X electrode and the Y electrode in the erase period, is set to a voltage greater than the discharge start voltage, ions are accumulated on the Y electrode side when the Y electrode is a cathode. In the cell that is not lit, these ions are added in the reset period of the next subfield when a waveform is applied so that the Y electrode becomes an anode. Therefore, it is recommended that the voltage to be applied to the Y electrode in the write period is not set to a comparably higher voltage in order to prevent a discharge from occurring in such case.

Figure 17:
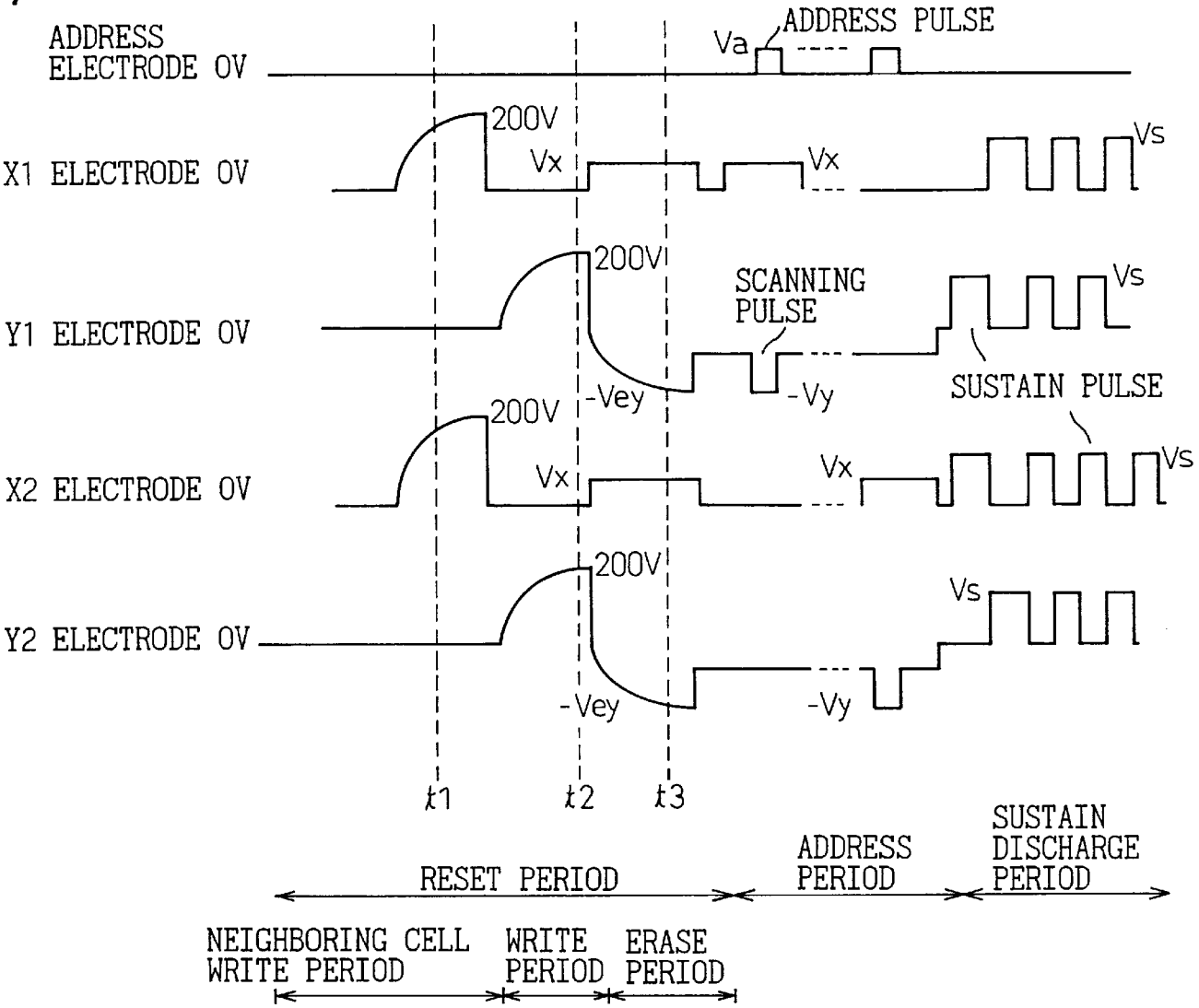
FIG. 17 is a diagram that shows the drive waveforms of the apparatus in the second embodiment of the present invention.

FIG. 17 is the drive waveform chart of the ALIS type PDP in the second embodiment of the present invention. The drive waveform differs from that in the first embodiment shown in FIG. 16 in the voltage relation of the waveform applied to the X and Y electrodes. While positive 170 V is applied to one of the electrode and negative 50 V is applied to the other electrode in FIG. 16, one of the electrodes is fixed to 0 V and a voltage of 200 V is applied to the other electrode including address electrodes in the present embodiment. This will simplify the drive circuit and abbreviate the operation time.

Figure 18:
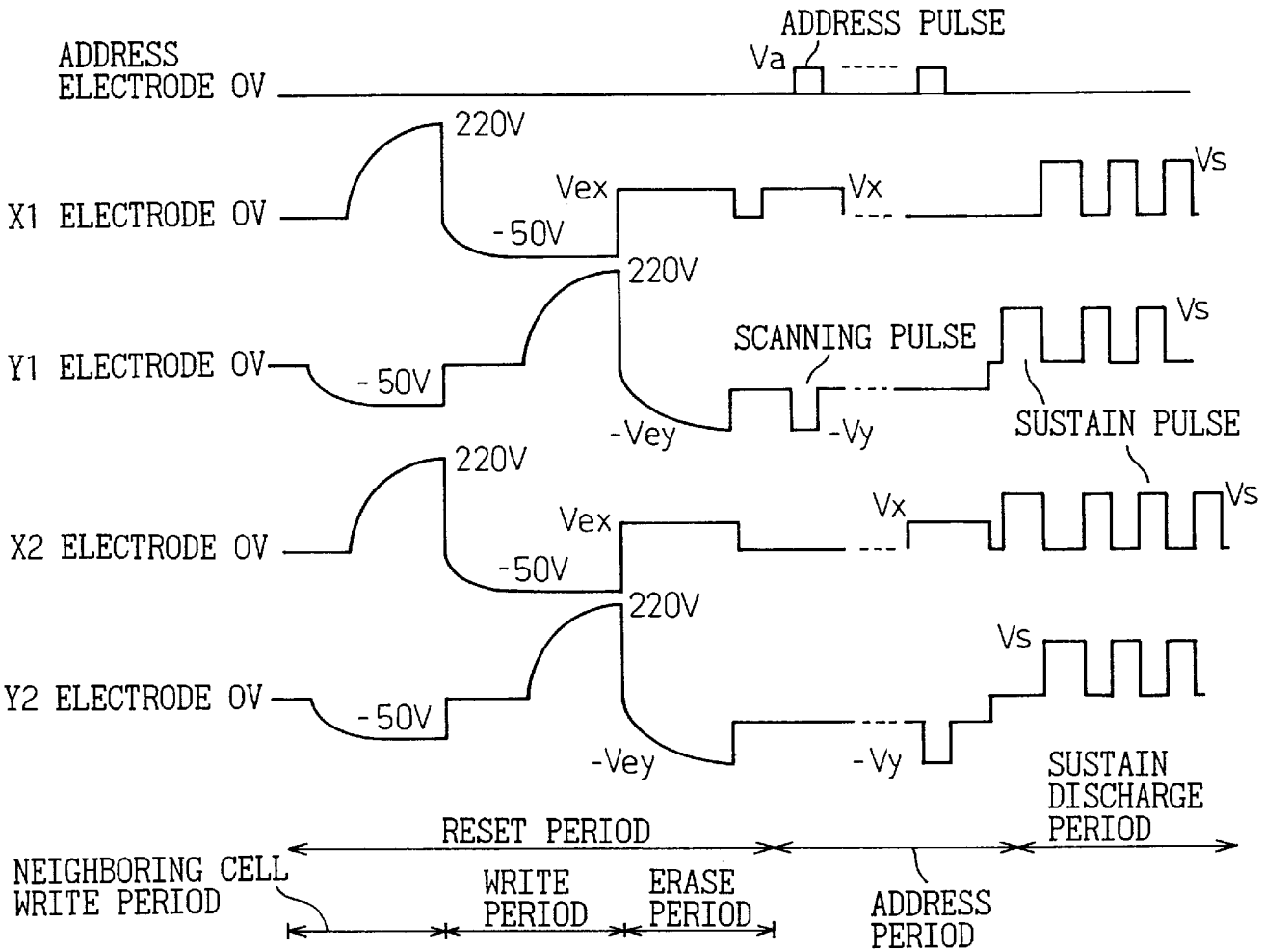
FIG. 18 is a diagram that shows the drive waveforms used in combination with those in the first and the second embodiments.

FIG. 18 is a diagram of an example of the drive waveform to be used in combination of the drive waveform in the first embodiment or the second embodiment. The drive waveform in FIG. 18 is applied to only one subfield of a field, for example the top subfield, and the drive waveform in FIG. 16 or FIG. 17 is applied to other subfields. The drive waveform in FIG. 18 is characterized in that a discharge is carried out in all the cells to complete the reset operation, regardless of the lighting conditions of the preceding subfield, because a voltage as high as 270 V, which exceeds the discharge start voltage, is applied between the X electrode and the Y electrode in the neighboring cell write period. Therefore, after the reset operation, ions and metastable atoms remain in the discharge space and the address discharge is made surely to occur. This is the so-called priming effect. This priming effect affects plural subsequent subfields.

Figure 19:
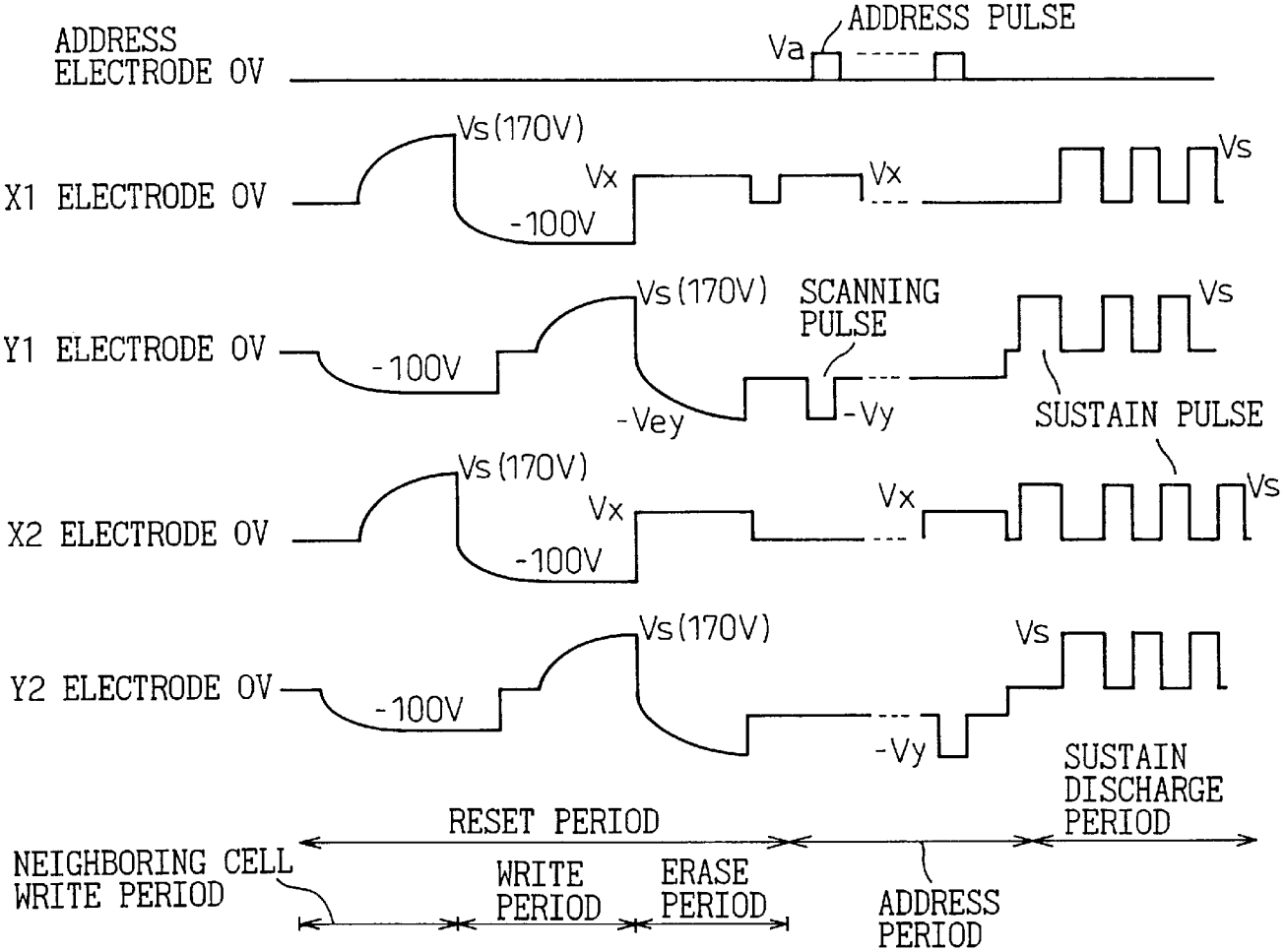
FIG. 19 is a diagram that shows other drive waveforms used in combination with those in the first and the second embodiments.

FIG. 19 is a diagram of an example of another drive waveform in the subfield to create the priming effect. In this case, the voltage of negative pulse to be applied to the Y electrode in the neighboring cell write period is set to negative 100 V.

The embodiments of the present invention are described above, and there may be various modifications.

According to the present invention, particularly in the ALIS method panel, the brightness of the black display can be reduced to a value lower than conventional ones without losing the stable operations of the panel, and the display contrast a the dark room, which used to be 500:1 conventionally, can be considerably improved to 3000:1 to 5000:1.

What is claimed is:

1. A method of driving a plasma display panel, comprising plural first and second electrodes spaced equally by turns and plural third electrodes provided so as to be apart from and perpendicular to said plural first and second electrodes, wherein:

a first display line is formed between said first electrode, facing one side of said second electrode and said second electrode, a second display line is formed between said first electrode, facing the other side of said second electrode, and said second electrode, and discharges for display are carried out in separte times for the first and the second display lines, respectively;

a reset period, an address period, in which each display cell is set to a state in accordance with display data, and a sustain discharge period, in which said display cell is made to emit light selectively in accordance with said display data, are provided; and said reset period comprises:

a write period, in which one of said first and said second electrodes functions as an anode, and a reset discharge voltage waveform, with a slope in which the voltage changes gradually as time goes by, is applied between said first electrode and said second electrode so that the voltage between said first electrode and said second electrode becomes lower than the discharge start voltage in display cells, other than first display cells that were lit in the preceding subfield and second display cells in one of the display lines contiguous to the first display cells, and a neighboring cell write period, in which the other one of said first and said second electrodes functions as an anode, and a voltage waveform with a slope, in which the voltage changes gradually as time changes, is applied between said first electrode and said second electrode so that the voltage between said first electrode and said second electrode becomes lower than the discharge start voltage in display cells, other than third display cells in other display lines contiguous to said first display cells.

2. The method of driving a plasma display panel as set forth in claim 1, wherein said neighboring cell write period is provided just before or after said write period.

3. The method of driving a plasma display panel as set forth in claim 1, wherein a field is composed of plural subfields and in the reset period in at least one subfield of said field, a voltage waveform with a gradual slope is applied so that the discharge start voltage is reached in all the cells regardless of the lighting state thereof in a next preceding subfield, and a reset discharge is caused to occur.

4. The method of driving a plasma display panel as set forth in claim 3, wherein a waveform, of a voltage larger than said discharge start voltage, is applied and a reset discharge is caused to occur in all the cells in the first subfield, after either an odd-numbered display subfield or an even-numbered display subfield is completed and when the other subfield is started.

5. The method of driving a plasma display panel as set forth in claim 3, wherein a waveform of a voltage larger than said discharge start voltage is applied and a reset discharge is caused to occur in all the cells in the first subfield when either an odd-numbered display subfield or an even-numbered display subfield is started.

6. The method of driving a plasma display panel as set forth in claim 1, wherein the voltage which is applied to said third electrode in said write period and said neighboring cell write period is between the maximum and the minimum of the voltage to be applied to said first electrode and said second electrode.

7. The method of driving a plasma display panel as set forth in claim 1, wherein an erase period is further provided in which an address prepare voltage waveform with a gradual slope is applied so that the voltage between said first electrode and said second electrode becomes larger than the discharge start voltage, after said write period and said neighboring cell write period, and after said erase period, said address action is carried out.

8. The method of driving a plasma display panel as set forth in claim 7, wherein the voltage of said first electrode of said address prepare voltage waveform, during the application of the voltage or at the end of the application, is nearly equal to that to be applied to said first electrode in said address period.

9. The method of driving a plasma display panel as set forth in claim 7, wherein the voltage of said second electrode of said address prepare voltage waveform, during the application of the voltage or at the end of the application, is nearly equal to that of the selective pulse to be applied to said second electrode in said address period.

10. The method of driving a plasma display panel as set forth in claim 9, wherein, the voltage between said first electrode and said second electrode is set to a lower one by approximately 10 V, compared to the case where the voltage of said second electrode of said address prepare voltage waveform, during the application of the voltage or at the end of the application, is made nearly equal to that of the selective pulse to be applied to said second electrode in said address period.

11. The method of driving a plasma display panel as set forth in claim 7, wherein the voltage of said third electrode of said address prepare voltage waveform, during the application of the voltage or at the end of the application, is nearly equal to that applied to said third electrode that is not selected in the address discharge period.

12. The method of driving a plasma display panel as set forth in claim 7, wherein said address prepare voltage waveform has a gradual slope so that said second electrode becomes a cathode and the voltage of the waveform, which makes said second electrode an anode in said write period or said neighboring cell write period, is lower than that of the waveform, which makes said first electrode an anode in said write period of said neighboring cell write period.

13. The method of driving a plasma display panel as set forth in claim 1, wherein the waveform to be applied to said first electrode and said second electrode, in said write period or said neighboring cell write period, is equal or larger than the maximum value and equal or smaller than the minimum value of the sustain discharge pulse to be applied to said first electrode and said second electrode in said sustain discharge period.

14. The method of driving a plasma display panel as set forth in claim 1, wherein only one of said write period or said neighboring cell write period is carried out in a subfield, in which the number of times of sustain discharge is small, in said sustain discharge period.

15. A plasma display panel, comprising plural first and second electrodes, spaced equally by turns, and plural third electrodes, provided so as to be apart from and perpendicular to said plural first and second electrode: wherein:

a first display line is formed between said first electrode, facing one side of said second electrode, and said second electrode, a second display line is formed between said first electrode, facing the other side of said second electrode and said second electrode, and discharges for display are carried out in separate times for the first and second display lines, respectively;

a drive circuit is provided, which carries out a reset action in which said first and second display lines are initialized, an address action in which each display cell is set to a state according to display data, and a sustain discharge action, in which said display cell is selectively made to emit light in accordance with said display data; and said drive circuit is characterized in that:

in said reset action, when either said first electrode or said second electrode functions as an anode and said drive circuit applies a reset discharge voltage waveform with a slope in which the voltage changes gradually as time changes, between said first electrode and said second electrode so that the voltage between said first electrode and said second electrode becomes lower than the discharge start voltage in display cells, other than first display cells that were lit in the preceding subfield and second display cells in one of the display lines contiguous to the first display cells, and when the other one of said first electrode and said second electrode functions as an anode, said drive circuit applies a voltage waveform with a slope, in which the voltage changes gradually as time changes, between said first electrode and said second electrode so that the voltage between said first electrode and said second electrode becomes lower than the discharge start voltage in display cells other than third display cells in other display lines contiguous to said first display cells.

16. A method of driving a plasma display panel having plural, spaced and alternating first and second electrodes and plural third electrodes, spaced from and perpendicular to the plural first and second electrodes and defining display cells therebetween, the alternating first and second electrodes defining corresponding and alternating first and second display lines therebetween, each display line comprising plural said display cells in which discharges for display are produced in alternate, separate time intervals in the corresponding cells of the first and second display lines, respectively, the method comprising:

in an address period, setting each display cell to a state in accordance with display data;

in a sustain discharge period, emitting light selectively from the display cells in accordance with the display data; and in a reset period:

during a write period, in which one of the first and second electrodes functions as an anode, applying a reset discharge voltage waveform having a slope in which the voltage changes gradually with time between the first electrode and the second electrode so that the voltage therebetween becomes lower than a discharge start voltage in display cells, other than first display cells that were lit in a next preceding subfield and second display cells in one of the display lines adjacent to the first display cells, and in a neighboring cell write period, in which the other one of the first and second electrodes functions as an anode, applying a voltage waveform having a slope in which the voltage changes gradually with time between the first electrode and the second electrode so that the voltage therebetween becomes lower than the discharge start voltage in display cells, other than third display cells in other display lines adjacent to the first display cells.

17. The method of driving a plasma display panel as set forth in claim 16, wherein said neighboring cell write period is provided just before or after said write period.

18. The method of driving a plasma display panel as set forth in claim 16, wherein a field is composed of plural subfields and in the reset period in at least one subfield of said field, a voltage waveform with a gradual slope is applied so that the discharge start voltage is reached in all the cells regardless of the lighting state thereof in a next preceding subfield, and a reset discharge is caused to occur.

19. The method of driving a plasma display panel as set forth in claim 18, wherein a waveform, of a voltage larger than said discharge start voltage, is applied and a reset discharge is caused to occur in all the cells in the first subfield, after either an odd-numbered display subfield or an even-numbered display subfield is completed and when the other subfield is started.

20. The method of driving a plasma display panel as set forth in claim 18, wherein a waveform of a voltage larger than said discharge start voltage is applied and a reset discharge is caused to occur in all the cells in the first subfield when either an odd-numbered display subfield or an even-numbered display subfield is started.

21. The method of driving a plasma display panel as set forth in claim 16, wherein the voltage which is applied to said third electrode in said write period and said neighboring cell write period is between the maximum and the minimum of the voltage to be applied to said first electrode and said second electrode.

22. The method of driving a plasma display panel as set forth in claim 16, wherein an erase period is further provided in which an address prepare voltage waveform with a gradual slope is applied so that the voltage between said first electrode and said second electrode becomes larger than the discharge start voltage, after said write period and said neighboring cell write period, and after said erase period, said address action is carried out.

23. The method of driving a plasma display panel as set forth in claim 22, wherein the voltage of said first electrode of said address prepare voltage waveform, during the application of the voltage or at the end of the application, is nearly equal to that to be applied to said first electrode in said address period.

24. The method of driving a plasma display panel as set forth in claim 22, wherein the voltage of said second electrode of said address prepare voltage waveform, during the application of the voltage or at the end of the application, is nearly equal to that of the selective pulse to be applied to said second electrode in said address period.

25. The method of driving a plasma display panel as set forth in claim 24, wherein the voltage between said first electrode and said second electrode is set to a lower one by approximately 10 V, compared to the case where the voltage of said second electrode of said address prepare voltage waveform, during the application of the voltage or at the end of the application, is made nearly equal to that of the selective pulse to be applied to said second electrode in said address period.

26. The method of driving a plasma display panel as set forth in claim 24, wherein the voltage of said third electrode of said address prepare voltage waveform, during the application of the voltage or at the end of the application, is nearly equal to that applied to said third electrode that is not selected in the address discharge period.

27. The method of driving a plasma display panel as set forth in claim 22, wherein said address prepare voltage waveform has a gradual slope so that said second electrode becomes a cathode and the voltage of the waveform, which makes said second electrode an anode in said write period or said neighboring cell write period, is lower than that of the waveform, which makes said first electrode an anode in said write period of said neighboring cell write period.

28. The method of driving a plasma display panel as set forth in claim 16, wherein the waveform to be applied to said first electrode and said second electrode, in said write period or said neighboring cell write period, is equal or larger than the maximum value and equal or smaller than the minimum value of the sustain discharge pulse to be applied to said first electrode and said second electrode in said sustain discharge period.

29. The method of driving a plasma display panel as set forth in claim 16, wherein only one of said write period or said neighboring cell write period is carried out in a subfield, in which the number of times of sustain discharge is small, in said sustain discharge period.

* * * * *